US005996621A

United States Patent [19]

Hagiwara et al.

[11] Patent Number: 5,996,621

[45] Date of Patent: Dec. 7, 1999

[54] CIRCULATING DRAINAGE SYSTEM FOR SEWAGE PIPE INSTALLATION WORK

[75] Inventors: Hideo Hagiwara; Sadamasa Kodaira, both of Tokyo, Japan

[73] Assignee: Komatsu Ltd., Tokyo, Japan

[21] Appl. No.: 09/043,583

[22] PCT Filed: Sep. 27, 1996

[86] PCT No.: PCT/JP96/02829

§ 371 Date: Mar. 26, 1998

§ 102(e) Date: Mar. 26, 1998

[87] PCT Pub. No.: WO97/12098

PCT Pub. Date: Apr. 8, 1997

[30] Foreign Application Priority Data

Sep. 27, 1995 [JP] Japan ..... 7-249151

[51] Int. Cl.[6] ..... E03F 9/00

[52] U.S. Cl. ..... 137/565.33; 137/565.23; 137/315; 138/93

[58] Field of Search ..... 137/565.01, 565.23, 137/565.29, 565.33, 315; 138/93; 417/36

[56] References Cited

U.S. PATENT DOCUMENTS 4,314,577 2/1982 Brister ..... 138/93 X
4,351,349 9/1982 Minotti ..... 138/93 X
4,417,598 11/1983 DePirro ..... 138/93 X
5,462,077 10/1995 Cohen et al. ..... 138/93 X

FOREIGN PATENT DOCUMENTS 6-13890 4/1994 Japan .
6-23832 6/1994 Japan .
7-2774 1/1995 Japan .

*Primary Examiner*—John Rivell
*Attorney, Agent, or Firm*—Armstrong, Westerman, Hattori, McLeland & Naughton

[57] ABSTRACT

A sewage by-pass drainage system for sewage pipe works comprises a submerge pump provided in a first manhole, a sewage pipe between a second manhole and a third manhole located at a downstream side of the first manhole being taken as a working zone, an upstream side stop plug being provided at an outflow side of a sewage pipe between the first manhole and the second manhole, and a downstream side stop plug being provided at an inflow side of a sewage pipe opening to the third manhole, a suction pipe of a suction drainage apparatus provided on the ground being projected into an upstream side of the upstream side stop plug, a discharge pipe of the suction drainage apparatus being projected into a downstream side of the downstream side stop plug, and a discharge pipe of the submerge pump being arranged to the downstream side of the downstream side stop plug. By this, a sewage or the like can be drained even from the deeply buried sewage pipe so that an odor may not leak above the ground.

5 Claims, 5 Drawing Sheets

CIRCULATING DRAINAGE SYSTEM FOR SEWAGE PIPE INSTALLATION WORK

TECHNICAL FIELD

The present invention relates to a sewage by-pass drainage system for sewage pipe works for preventing a sewage or so forth from flowing into a working zone upon working of cleaning, inspection, maintenance, exchange and so forth of a sewage pipe buried under the ground.

BACKGROUND ART

Within a sewage pipe buried under the ground, sediment, sludge and foreign matter may be accumulated by use for a long period. Therefore, it becomes necessary to remove the accumulated sediment, sludge and foreign matter and clean the sewage pipe.

Further, since the sewage pipe buried under the ground may be deteriorated as time goes, clacks and failures of joint portions and so forth can be caused. Particularly, when the sewage pipe is Hume pipe, a hole can be formed by corrosion. Accordingly, it becomes necessary to perform an inspection of the inside of the sewage pipe and to regularly perform a maintenance and an exchange.

As set forth above, upon performing a working of cleaning, inspection, maintenance, exchange and so forth of the sewage pipe, it has to be necessary to interrupt use of the sewage system during a working period since an equipment has to be inserted within the sewage pipe in the working zone or a worker has to enter the sewage pipe for working.

As a solution for the foregoing problem, a sewage by-pass drainage system for sewage pipe works disclosed in Japanese Examined Utility Model Publication (Kokoku) No. Heisei 6-13890, for example, has been known.

As shown in FIG. 5, the foregoing sewage by-pass drainage system for sewage pipe works 1 defines a working zone for a portion 1*a* between a first manhole 2 and a second manhole 3 of the sewage pipe 1, and provides stop plugs 4 at a portion 1*b* of upstream side and a portion 1*c* of downstream side of the sewage pipe 1*a* as the working zone so that the sewage or so forth may not flow in the sewage pipe 1*a* of the working zone.

Then, a suction pipe 6 of the pump 5 arranged on the ground is arranged at the portion 1*b* of the upstream side and a discharge pipe 7 of the pump 5 is arranged at the portion 1*c* of the downstream side so that the sewage or so forth at the upstream side of the working zone flows to the downstream side by-passing the working zone.

By the sewage by-pass drainage system for sewage pipe works as set forth above, the sewage or so forth may not flow through the sewage pipe of the working zone while the sewage system is used. Therefore, a working of cleaning, inspection, maintenance, exchange or so forth of the sewage pipe of the working zone, can be done with using the sewage system.

However, in the sewage by-pass drainage system for sewage pipe works as set forth above, by means of the pump 5 installed on the ground, the sewage or so forth within the sewage pipe is sucked. Since a pump head H required for the pump 5 is large, the sewage in the sewage pipe cannot be sucked sufficiently.

Particularly, since the burying depth of the main pipe of the sewage pipe is deep, the pump head required for the pump 5 is significantly large to make it impossible to suck the sewage or so forth in the sewage pipe.

Further, a screen 8 is provided on the ground so as to avoid a penetration of foreign matter in the sewage or so forth into the pump. Since such screen 8 tends to be stuffed, it has to be regularly cleaned and exchanged. However, on the ground, upon cleaning and exchanging of the screen 8, the sewage or so forth can flow out to cause a leakage of odor to the environment to be undesirable in view point of the environment protection.

Therefore, it is an object of the present invention to provide a sewage by-pass drainage system for sewage pipe works so that sewage or so forth can be drained even for the deeply buried sewage pipe and an odor may not leak on the ground.

DISCLOSURE OF THE INVENTION

In order to accomplish the above-mentioned object, according to one aspect of the invention, a sewage by-pass drainage system for sewage pipe works comprises, a submerge pump provided in a first manhole, a sewage pipe between a second manhole and a third manhole located at a downstream side of the first manhole being taken as a working zone, an upstream side stop plug being provided at outflow side of a sewage pipe between the first manhole and the second manhole, and a downstream side stop plug being provided at an inflow side of a sewage pipe opening to the third manhole, a suction pipe of a suction drainage apparatus provided on the ground being projected into an upstream side of the upstream side stop plug, a discharge pipe of the suction drainage apparatus being projected into a downstream side of the downstream side stop plug, and a discharge pipe of the submerge pump being arranged to the downstream side of the downstream side stop plug.

In the construction set forth above, it is desirable that the discharge pipe of the suction drainage apparatus and a discharge pipe of the submerge pump are arranged to the downstream side of the downstream side stop plug through the inside of the downstream side stop plug.

The discharge pipe of the suction drainage apparatus and the discharge pipe of the submerge pump are preferably arranged to the fourth manhole located at a downstream side of the third manhole.

It is further preferred that a net is provided at an inflow side of a sewage pipe between the first manhole and the second manhole.

Further desirably, a level sensor detecting a water level of upstream side of the upstream side stop plug is provided for actuating the suction drainage apparatus when the water level detected by the level sensor becomes higher than or equal to a predetermined height.

Advantages of the sewage by-pass drainage system for sewage pipe works according to the present invention, having the foregoing aspect, are as follows.

According to the present invention, since a sewage or the like in the upstream side of the sewage pipe in the working zone is drained to the downstream side by the submerge pump, the sewage or the like will never flow through the working zone. Also, even when the buried depth of the sewage pipe is deep, the submerge pump has a discharge performance. Also, since the submerge pump has an ability of crushing a large foreign matter, it can surely drain the sewage or the like without being stuffed.

Further, since the discharge pipe of the submerge pump is extended to the downstream side of the downstream side stop plug, the sewage or the like will never be spilled on the ground, and the odor may not leak on the ground. Thus, it is favorable for the environment protection.

Further, even when a domestic waste water flows into the sewage pipe between the first manhole and the second manhole, such sewage or the like can be drained by the suction drainage apparatus.

Furthermore, when the working is to be performed in the sewage pipe between the second manhole and the third manhole, since the worker may enter and exit through the second manhole and the third manhole to facilitate the working. In addition, the upstream side stop plug and the downstream side stop plug can be installed from the second manhole and the third manhole, such working can be facilitated.

Furthermore, the large foreign matter flowing into the first manhole can be captured by the net. Therefore, the large foreign matter will never enter into the sewage pipe between the first manhole and the second manhole to avoid plugging of the suction drainage apparatus.

In addition, the water level of sewage or the like at the upstream side of the upstream side stop plug can be detected by the level sensor for draining the sewage so as not to be higher than a predetermined height.

BRIEF DESCRIPTION OF THE DRAWINGS

The present invention will be understood more fully from the detailed description given here below and from the accompanying drawings of the preferred embodiment of the present invention, which, however, should not be taken to be limitative to the invention, but are for explanation and understanding only.

In the drawings.

BEST MODE FOR IMPLEMENTING THE INVENTION

The preferred embodiment of a sewage by-pass drainage system for sewage pipe works according to the present invention will be discussed hereinafter with reference to the accompanying drawings.

Figure 1:
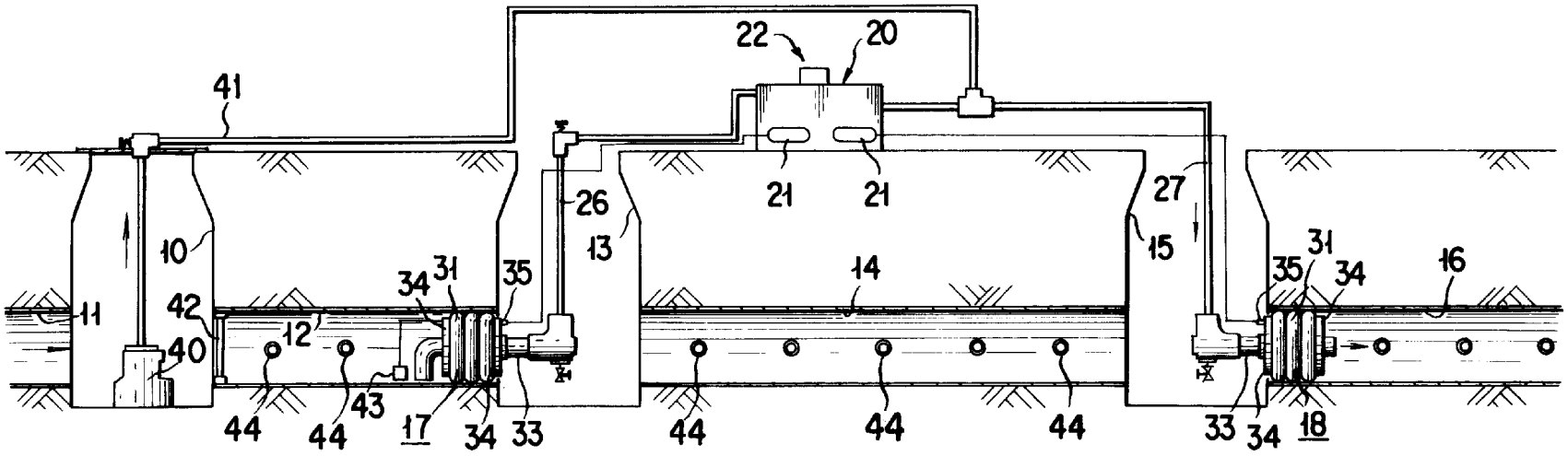
FIG. 1 is a longitudinal section showing one embodiment of a sewage by-pass drainage system for sewage pipe works according to the present invention.

FIG. 1 is an illustration showing one embodiment of a sewage by-pass drainage system for sewage pipe works according to the present invention. In the sewage by-pass drainage system for sewage pipe works, a first sewage pipe 11 opens to a first manhole 10. A second sewage pipe 12 opens to the first manhole 10 and also to a second manhole 13. A third sewage pipe 14 opens to the second manhole 13 and also to a third manhole 15. A fourth sewage pipe 16 opens to the third manhole 15. The foregoing sewage pipes are continuous through the manholes and are buried under the ground. The sewage or the like flows from the first sewage pipe 11 to the fourth sewage pipe 16.

When the third sewage pipe 14 is taken as a working zone, an upstream side stop plug 17 is provided in the upstream side of the third sewage pipe 14, namely in the outflow side of the second sewage pipe 12 opening to the second manhole 13. On the other hand, a downstream side stop plug 18 is provided in the downstream side of the third sewage pipe 14, namely in the inflow side of the fourth sewage pipe 16 opening to the third manhole 15. Accordingly, the sewage or the like flowing from the sewage pipe at the upstream side may not flow into the third sewage pipe 14 as the working zone.

It should be noted that the reason why the stop plugs are provided in the outflow side of the second sewage pipe 12 and the inflow side of the fourth sewage pipe 16 instead of providing the stop plugs in the inflow side and the outflow side of the third sewage pipe 14, is that the worker may enter and exit through the second manhole 13 and the third manhole 15.

On the ground, a control system constructed of a suction drainage apparatus 20, a controlled compressor and a controller 22 and so forth, is provided.

Figure 2:
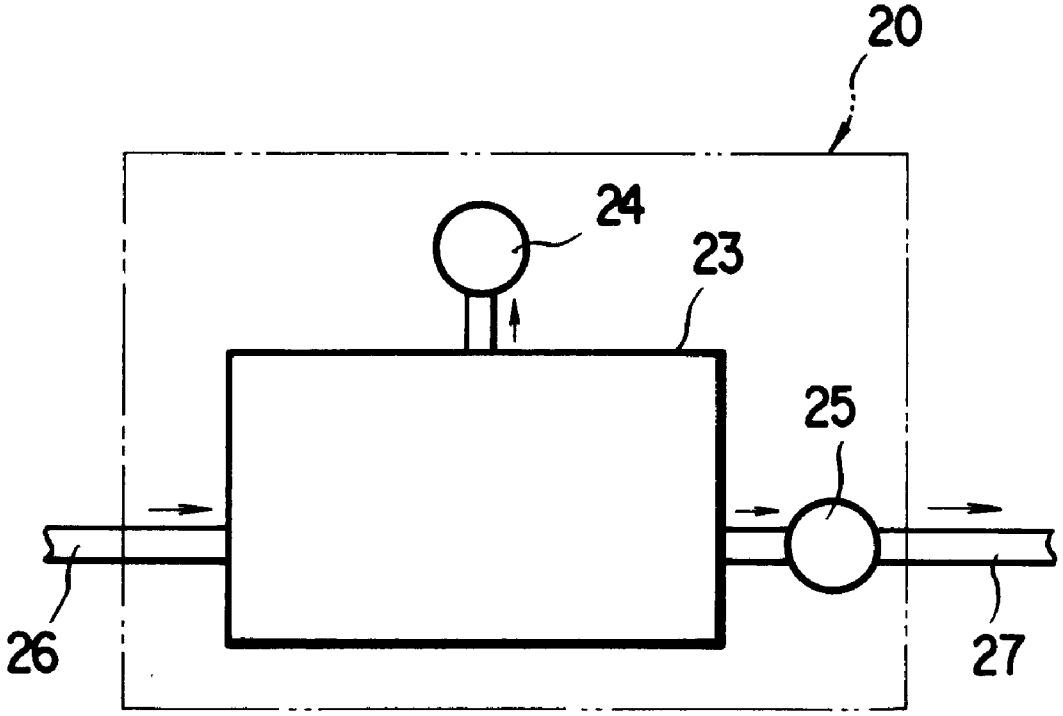
FIG. 2 is an explanatory illustration of a suction drainage system according to the present invention.

The suction drainage apparatus 20 includes a tank 23, a vacuum suction pump 24 and a pressurization delivering pump 25, as shown in FIG. 2. By the vacuum suction pump 24, air in the tank 23 is sucked. By the suction pipe 26, the sewage or the like is sucked into the tank 23. The sewage or the like in the tank 23 is fed to a drainage pipe 27 under pressure by the pressurization delivering pump 25.

The controller 22 controls the controlled compressor 21, a vacuum suction pump 24, the pressurization delivering pump 25 or so forth.

Figure 3:
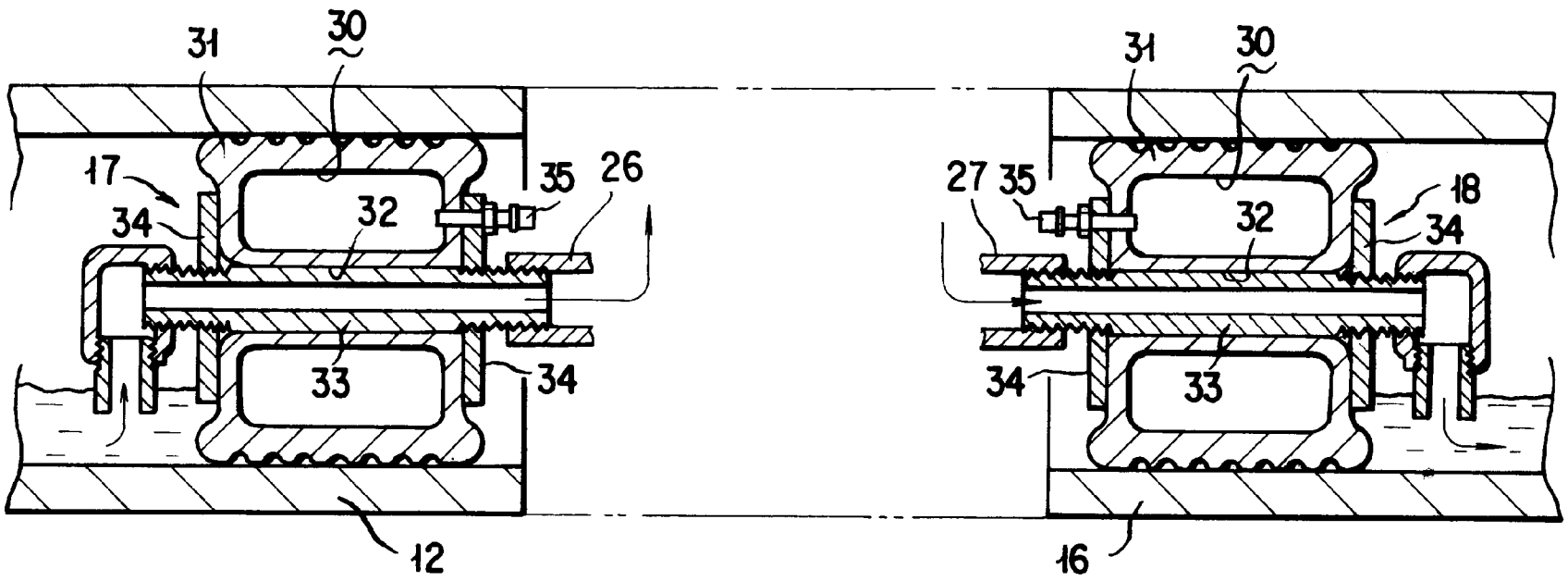
FIG. 3 is a section of an upstream side stop plug and a downstream side stop plug, according to the invention.

Each of the upstream side stop plug 17 and the downstream side stop plug 18 is constructed with a ring-shaped main body 31 formed of a flexible material, such as rubber or the like with a hollow portion 30, a pipe 33 inserted through a central through hole 32 of the main body 31, a pair of holding plates 34 threadingly engaged with both longitudinal ends of the pipe 33 and contacting with the main body 31, and a nozzle 35 mounted on one of the holding plate 34, as shown in FIG. 3. The nozzle 35 is connected to the compressor 21.

With the construction as set forth above, when air is supplied from the nozzle 35 to the hollow portion 30 of the main body 31 by driving the compressor 21, the main body 31 expands to be deformed to fit on the inner periphery of the sewage pipe under pressure. By this, a superior stop performance can be achieved.

Then, the suction pipe 26 is connected to the pipe 33 of the upstream side stop plug 17 and the discharge pipe 27 is connected to the pipe 33 of the downstream side stop plug 18.

Within the first manhole 10, a submerged pump, such as a submerged grinder pump 40, is provided. A discharge pipe 41 is connected to the discharge pipe 27. On the other hand, in the inflow side of the second sewage pipe 12 opening to the first manhole 10, a net 42 is provided.

Accordingly, the sewage or so forth flowing in the first manhole 10 and accumulated therein is sucked by the submerged grinder pump 40, and discharged from the discharge pipe 41 to the downstream side of the downstream side stop plug 18 via the discharge pipe 27.

It should be noted that the discharge pipe 41 of the submerged grinder pump 40 may be directly arrange in the sewage pipe at the downstream side of the downstream side stop plug 18. For example, the discharge pipe 41 is projected into the manhole at downstream side of the third manhole 15 to discharge the sewage into the sewage pipe from the manhole.

Since the submerged grinder pump 40 is superior in the discharge performance, even when a pump head required for the pump is large due to the deep manhole, the sewage or the like can be sufficiently fed to on the ground. Furthermore, since the submerged grinder pump 40 has a performance for crushing large size foreign matter, such as wooden piece or so forth, the pump may not be plugged.

It should be noted that, in the vicinity of the upstream side of the upstream side stop plug 17, a level sensor 43 is provided. When a water level in the second sewage pipe 12 reaches a predetermined height, the level sensor outputs a signal. The signal is fed to the controller 22 to drive the vacuum suction pump 24 and the pressurization delivering pump 25 for sucking the sewage or the like in the second sewage pipe 12 through the pipe 33 and the suction pipe 26, and discharge the sewage to the downstream side of the downstream side stop plug 18 via the discharge pipe 27 and the pipe 33 by the pressurization delivering pump 25.

Namely, even when the sewage or the like in the first manhole 10 is discharged by the submerged grinder pump 40, the sewage or the like flows into the second sewage pipe 12 from the domestic waste water pit via the drainage pipe 44. Therefore, when the sewage or the like is accumulated in the second sewage pipe 12 in certain amount, the suction drainage apparatus 20 is driven for draining.

As set forth above, since the suction drainage apparatus 20 is exploratory, no problem will be arisen even when a suction performance thereof is low.

It should be noted that since the net 42 is provided at the inflow side of the second sewage pipe 12, the large foreign matter flowing into the first manhole 10 may not enter the second sewage pipe 12. On the other hand, it may be possible to provide a stop plug in place of the net 42 to prevent the sewage in the upstream side from flowing into the second sewage pipe 12. Accordingly, the suction drainage apparatus 20 will never been plugged.

Namely, it is rare for the large foreign matter to flow into the sewage pipe from the catch-basins of the home, and most of such large foreign matters flow into the sewage pipe from a street inlet. Therefore, the large foreign matter will never penetrate the second sewage pipe 12.

Figure 4:
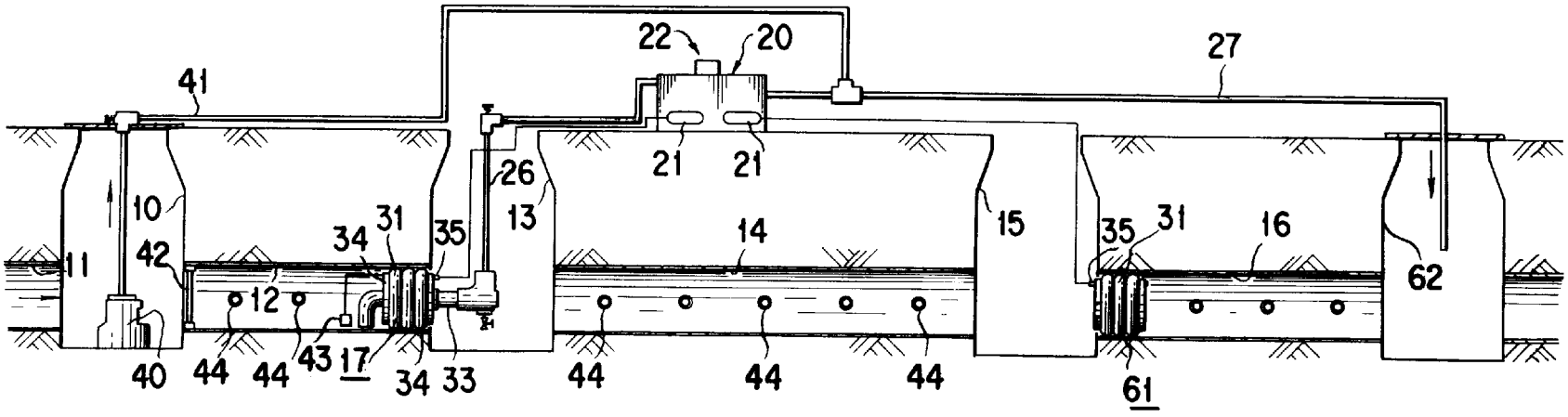
FIG. 4 is a longitudinal section showing another embodiment of a sewage by-pass drainage system for sewage pipe works according to the present invention.
Figure 5:
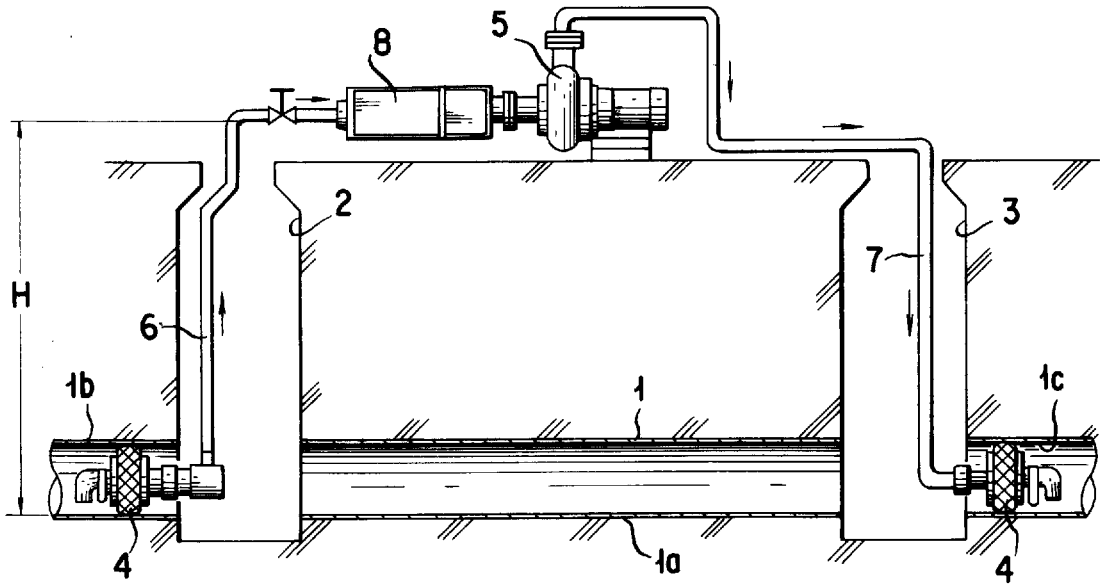
FIG. 5 PRIOR ART
FIG. 5 is a longitudinal section showing the conventional sewage by-pass drainage system for sewage pipe works.

On the other hand, as shown in FIG. 4, to the inflow side of the fourth sewage pipe 16 opening to the third manhole 15, a stop plug 61 having no pipe inserted for discharging the sewage is provided in the hollow portion to prevent the sewage from penetrating the third sewage pipe 14 as the working zone by a surge flow of the sewage or the like from the sewage pipe of the downstream side. On the other hand, the discharge pipe 27 is provided in a fourth manhole 62 at the downstream of the stop plug 61.

As set forth above, the structure of the stop plug 61 becomes simple to facilitate production.

It should be noted that, while not illustrated, similarly, even in the inlet port of the upstream side, at the downstream side of the pipe for sucking the sewage of the upstream, the stop plug having no pipe for sucking the sewage in the hollow portion may be provided.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

We claim:

1. A sewage by-pass drainage system for sewage pipe works comprising, a submerge pump provided in a first manhole, a first sewage pipe between a second manhole and a third manhole located at a downstream side of said first manhole being taken as a working zone, an upstream side stop plug being provided at an outflow side of a second sewage pipe between said first manhole and said second manhole, and a downstream side stop plug being provided at an inflow side of a third sewage pipe opening to said third manhole, a suction pipe of a suction drainage apparatus provided on the ground being projected into an upstream side of said upstream side stop plug, a discharge pipe of said suction drainage apparatus being projected into a downstream side of said downstream side stop plug, and a discharge pipe of said submerge pump being connected to the downstream side of said downstream side stop plug.

2. A sewage by-pass drainage system for sewage pipe works as set forth in claim 1, wherein said discharge pipe of said suction drainage apparatus and said discharge pipe of said submerge pump are connected to the downstream side of said downstream side stop plug through the inside of said downstream side stop plug.

3. A sewage by-pass drainage system for sewage pipe works as set forth in claim 1, wherein said discharge pipe of said suction drainage apparatus and a discharge pipe of said submerge pump are connected to a fourth manhole located at a downstream side of said third manhole.

4. A sewage by-pass drainage system for sewage pipe works as set forth in claim 1, a net is provided at an inflow side of said second sewage pipe between said first manhole and said second manhole.

5. A sewage by-pass drainage system for sewage pipe works as set forth in claim 1, 2, 3 or 4, wherein a level sensor detecting a water level upstream of said upstream side stop plug is provided for actuating said suction drainage apparatus when the water level detected by said level sensor becomes higher than or equal to a predetermined height.

* * * * *